US007762766B2

(12) United States Patent
Shteyman et al.

(10) Patent No.: US 7,762,766 B2
(45) Date of Patent: Jul. 27, 2010

(54) CANTILEVERED FRAMEWORK SUPPORT FOR TURBINE VANE

(75) Inventors: Yevgeniy Shteyman, West Palm Beach, FL (US); John Strain, Tequesta, FL (US); William R. Ryan, Oviedo, FL (US); Robert W. Spitzer, Casselberry, FL (US)

(73) Assignee: Siemens Energy, Inc., Orlando, FL (US)

( * ) Notice: Subject to any disclaimer, the term of this patent is extended or adjusted under 35 U.S.C. 154(b) by 1055 days.

(21) Appl. No.: 11/481,723

(22) Filed: Jul. 6, 2006

(65) Prior Publication Data

US 2008/0008584 A1 Jan. 10, 2008

(51) Int. Cl.
*F01D 9/04* (2006.01)

(52) U.S. Cl. ..... 415/190; 415/135; 415/138; 415/139; 415/209.2; 415/209.3; 415/209.4; 60/800

(58) Field of Classification Search ..... 415/135–136, 415/137–139, 142, 189–190, 209.2, 209.3, 415/209.4; 60/796, 798, 800
See application file for complete search history.

(56) References Cited

U.S. PATENT DOCUMENTS 3,609,968 A 10/1971 Mierley, Sr. et al.
3,670,497 A 6/1972 Sheldon
4,016,718 A 4/1977 Lauck
4,478,551 A * 10/1984 Honeycutt et al. ..... 415/142
4,503,668 A 3/1985 Duncan, III et al.
4,511,306 A * 4/1985 Hultgren ..... 415/136
4,566,851 A 1/1986 Comeau et al.
4,948,333 A 8/1990 Meer et al.
4,979,872 A * 12/1990 Myers et al. ..... 415/142
5,076,049 A * 12/1991 Von Benken et al. ..... 415/142
5,387,082 A 2/1995 Matyscak
5,441,385 A 8/1995 Boyd et al.
5,494,402 A 2/1996 Glezer et al.
5,630,700 A 5/1997 Olsen et al.

* cited by examiner

*Primary Examiner*—Christopher Verdier

(57) ABSTRACT

A support for the first row turbine vanes (12) in a gas turbine engine, the support including a support framework (18). The support framework (18) includes an outer vane carrier (34), and an inner vane carrier (36) connected to the outer vane carrier (34) by a plurality of struts (44, 46). The outer vane carrier (34) is mounted to an inner casing (16) of the engine and the struts (44, 46) support the inner vane carrier (36) in cantilevered relation to the outer vane carrier (34). An aft outer flange (94) of each first row vane (12) is supported on the outer vane carrier (34) and a forward inner flange (114) of the vane (12) is support on the inner vane carrier (36).

20 Claims, 4 Drawing Sheets

CANTILEVERED FRAMEWORK SUPPORT FOR TURBINE VANE

FIELD OF THE INVENTION

This invention relates to a support for a vane in a turbine engine and, more particularly, to a cantilevered framework for supporting turbine vanes.

BACKGROUND OF THE INVENTION

Generally, combustion turbines have three main assemblies, including a compressor assembly, a combustor assembly, and a turbine assembly. In operation, the compressor assembly compresses ambient air. The compressed air is channeled into the combustor assembly where it is mixed with a fuel. The fuel and compressed air mixture is ignited creating a heated working gas. The heated working gas is typically at a temperature of between 2500 to 2900° F. (1371 to 1593° C.), and is expanded through the turbine assembly. The turbine assembly generally includes a rotating assembly comprising a centrally located rotating shaft and a plurality of rows of rotating blades attached thereto. A plurality of stationary vane assemblies, each including a plurality of stationary vanes, are connected to a casing of the turbine and are located interposed between the rows of rotating blades. The expansion of the working gas through the rows of rotating blades and stationary vanes or airfoils in the turbine assembly results in a transfer of energy from the working gas to the rotating assembly, causing rotation of the shaft.

The vane assemblies may typically include an outer platform element or shroud segment connected to one end of an airfoil for attachment to the turbine casing and an inner platform element connected to an opposite end of the airfoil for attachment to the compressor diffuser exit structure. The outer platform elements may be located adjacent to each other to define an outer shroud, and the inner platform elements may be located adjacent to each other to define an inner shroud. The outer and inner shrouds define a flow channel therebetween for passage of the hot gases past the stationary airfoils.

The first row of vane assemblies, which typically precedes the first row of rotating blades in the turbine assembly, is subject to the highest temperatures of the working gas, and the support scheme for the first row vanes must provide a fail-safe support structure under an extreme of structural and thermal loading. Typically, the first row vanes have been "simply" supported, where the outer platform elements of the first row vanes are attached to the turbine structure, i.e., to an inner turbine casing, and the inner platform elements are attached to the compressor exit diffuser structure. During transient and steady state operation of the turbine, the axial displacement of the inner and outer support structures is not the same due to differential thermal growth of the two structures. This produces significant differential axial displacements between the inner and outer platform elements of the vane. The differential axial displacements can produce high stresses within the vane. In addition, the differential axial displacements can cause ID-to-OD rocking of the vane between the inner platform element of the vane and the transition duct from the combustor, potentially resulting in substantial gas leakage and loss of efficiency due to the large relative displacement.

One approach to solving the problems associated with the differential thermal displacement is to support the vane entirely at the OD of the turbine, referred to as a cantilevered vane. However, this approach can produce unacceptable stresses in the vane, particularly in heavily loaded vanes of more advanced turbine designs.

Accordingly, it is an object of the present invention to provide support at the vane OD and ID with this support being provided substantially by the OD of the turbine vane carrier, hence greatly reducing the vane rocking associated with transient and steady state differential thermal growth of the turbine.

SUMMARY OF THE INVENTION

In accordance with one aspect of the invention, a support is provided for a vane in a turbine engine. The support comprises a framework including an outer vane carrier and an inner vane carrier. A strut structure extends radially inwardly from the outer vane carrier and is rigidly connected to the outer and inner vane carriers. The outer vane carrier includes an outer support member for engaging and supporting an outer flange of a vane, and the inner vane carrier includes an inner support member for engaging and supporting an inner flange of the vane.

In accordance with a further aspect of the invention, a support is provided for a vane in a turbine engine comprising an inner casing. The support comprises a framework mounted to the inner casing and includes an annular outer vane carrier and an annular inner vane carrier. A strut structure comprising a plurality of struts extends radially inwardly from the outer vane carrier and is rigidly connected to the outer and inner vane carriers. The outer vane carrier includes an outer support member for engaging and supporting an outer flange of a vane, and the inner vane carrier includes an inner support member for engaging and supporting an inner flange of the vane to axially locate the inner flange.

In accordance with another aspect of the invention, a vane assembly is provided in a turbine engine comprising an inner casing. The assembly comprises a framework mounted to the inner casing and includes an annular outer vane carrier and an annular inner vane carrier. A strut structure comprises a plurality of struts rigidly connected to the outer and inner vane carriers to support the inner vane carrier in cantilevered relation radially inwardly from the outer vane carrier. A plurality of first row turbine vanes are supported from the outer vane carrier, and the inner vane carrier includes an inner support member for engaging and supporting the turbine vanes from the inner vane carrier for locating the turbine vanes in an axial direction relative to the inner vane carrier.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
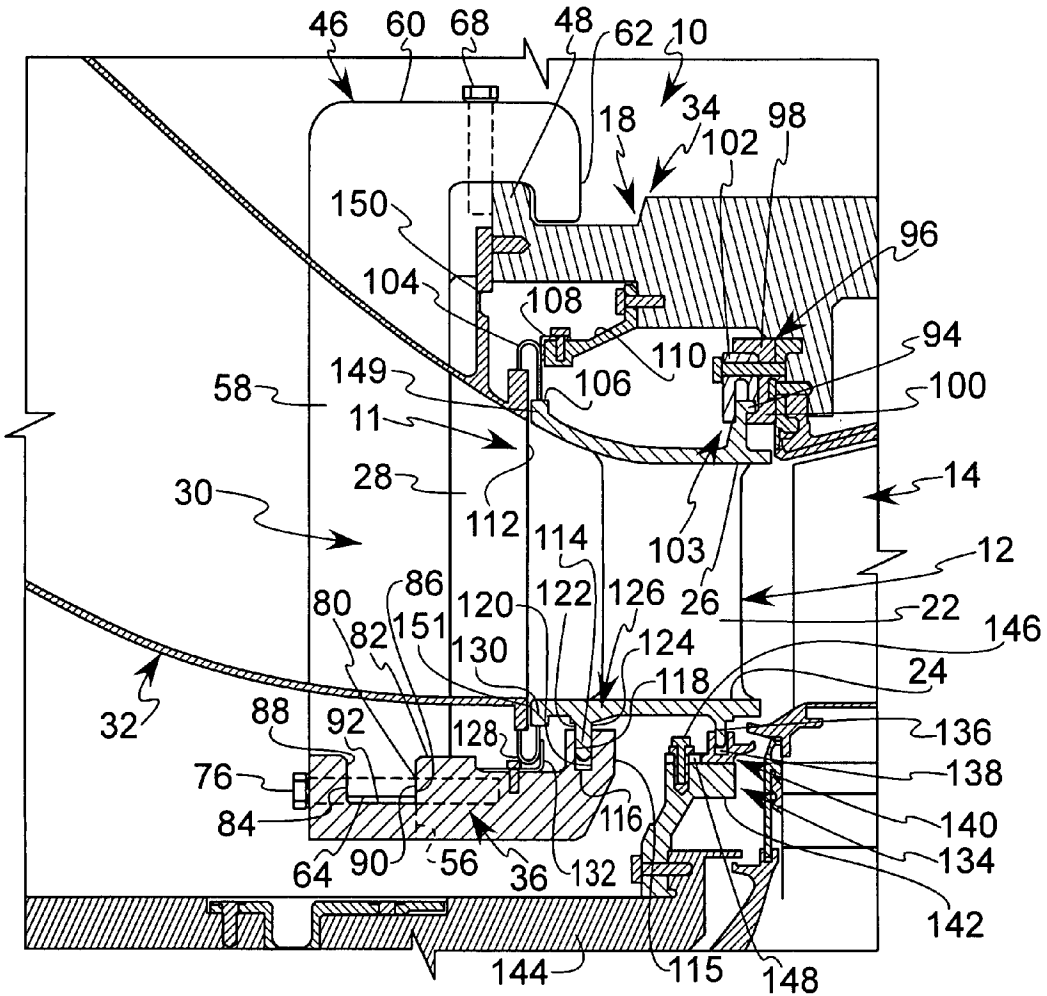
FIG. 1 is a cross-sectional side view of an entrance to a turbine assembly for a combustion turbine engine incorporating a cantilevered vane supporting framework structure in accordance with the present invention.

Referring to FIG. 1, the entrance to a turbine assembly 10 of a combustion turbine engine is shown and includes a turbine vane array, where the illustrated turbine vane array comprises a first row vane array 11 including a plurality of substantially similar stationary vanes 12 (only one shown). The first row vane array 11 precedes and is adjacent to a plurality of rotating blades 14 (only one blade shown). The vanes 12 are arranged annularly and are supported around an inner casing 16 (FIG. 2) of the turbine assembly 10 by a framework structure 18, which will be described in greater detail below. The vanes 12 generally comprise at least one elongated airfoil 22, an inner platform or shroud segment 24 and an outer platform or shroud segment 26 located at opposing ends of the airfoil 22 and forming an integral structure with the airfoil 22. The inner shroud segments 24 of the plurality of vanes 12 forming the turbine vane array 11 define an inner boundary of an annular gas path 28, and the outer shroud segments 26 define an outer boundary of the annular gas path 28. The annular gas path 28 receives a hot working gas flowing in a direction 30 from a transition duct 32 extending from a combustor (not shown) for the combustion turbine engine.

Figure 2:
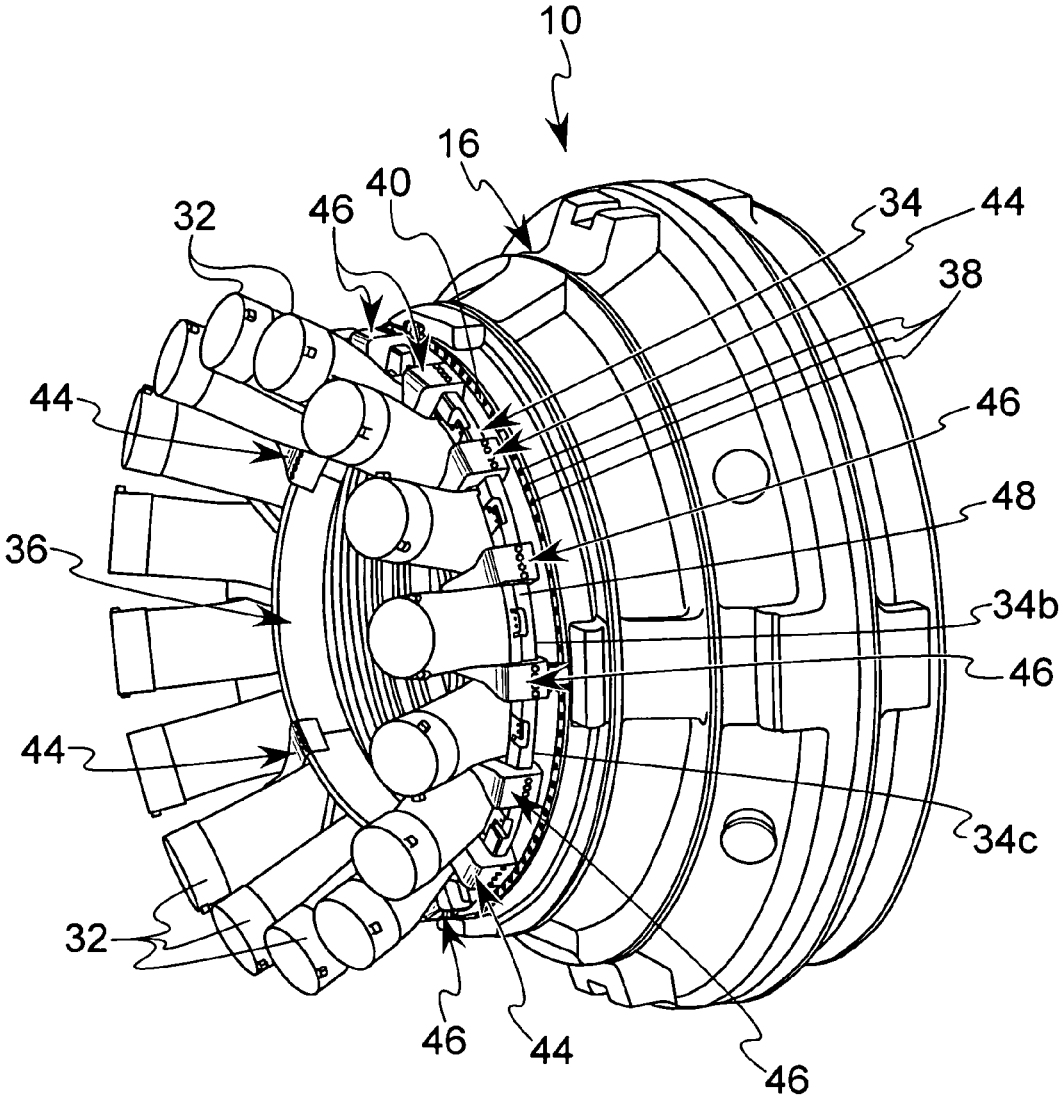
FIG. 2 is a perspective view of the entrance portion of the turbine assembly.
Figure 3:
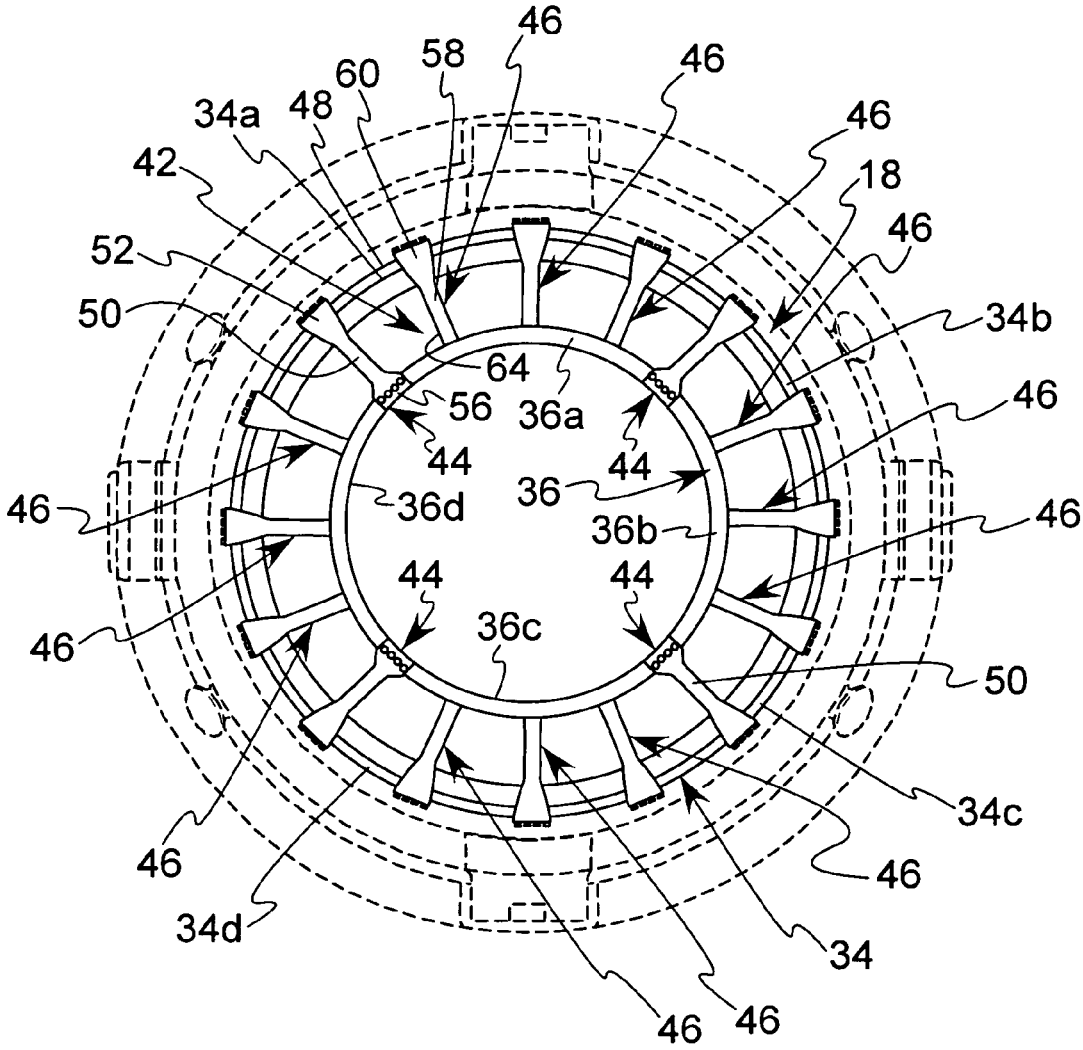
FIG. 3 is a front elevational view of the cantilevered vane supporting framework structure.

Referring additionally to FIGS. 2 and 3, the vanes 12 are supported to the inner casing 16 by the framework structure 18, which comprises an outer vane carrier, illustrated herein as an annular outer diameter (OD) ring 34, and an inner vane carrier, illustrated herein as an annular inner diameter (ID) ring 36 located concentrically inside the OD ring 34. The OD ring 34 of the framework structure 18 may be attached to a front face of the inner casing 16 by a plurality of bolts 38 extending through a rear flange 40 of the OD ring 34 into the inner casing 16. The ID ring 36 is supported from the OD ring 34 by a strut structure 42 (FIG. 3) comprising a plurality of radially extending support struts. The support struts include main struts 44 and intermediate struts 46 circumferentially spaced from each other around the framework structure 18. In the illustrated embodiment, the struts 44, 46 are equally spaced at angular intervals of approximately 22.5°. The space between adjacent pairs of struts 44, 46 comprises a passage for receiving a respective transition duct 32 extending from the combustor to a location adjacent a leading edge of the vanes 12, see FIG. 1. It should be understood that the present invention is not limited to a particular spacing between the struts 44, 46 or a particular number of transition ducts 32 located around the circumference of the framework structure 18.

Referring to FIGS. 1 and 2, the OD ring 34 includes a radially extending rim 48 located along a forward face of the OD ring 34, and forming a mounting lip for the struts 44, 46. The main struts 44 are angularly spaced 90° from each other. As seen in FIG. 3, each of the main struts 44 includes a strut body 50, an outer end 52 having a radial flange 54 (FIG. 4) for extending behind the rim 48 and attaching to the OD ring 34, and an inner end 56 for attachment to the ID ring 36. Three intermediate struts 46 are located between each pair of main struts 44. Each of the intermediate struts 46 includes a strut body 58, an outer end 60 having a radial flange 62 (FIG. 1) for extending behind the rim 48 and attaching to the OD ring 34, and an inner end 64 for engagement with the ID ring 36. The outer ends 52, 60 of the struts 44, 46 may be attached to the OD ring 34 by respective sets of bolts 66, 68, see FIG. 4, such that the struts 44, 46 are rigidly supported to extend inwardly in cantilevered relation from the OD ring 34.

Figure 5:
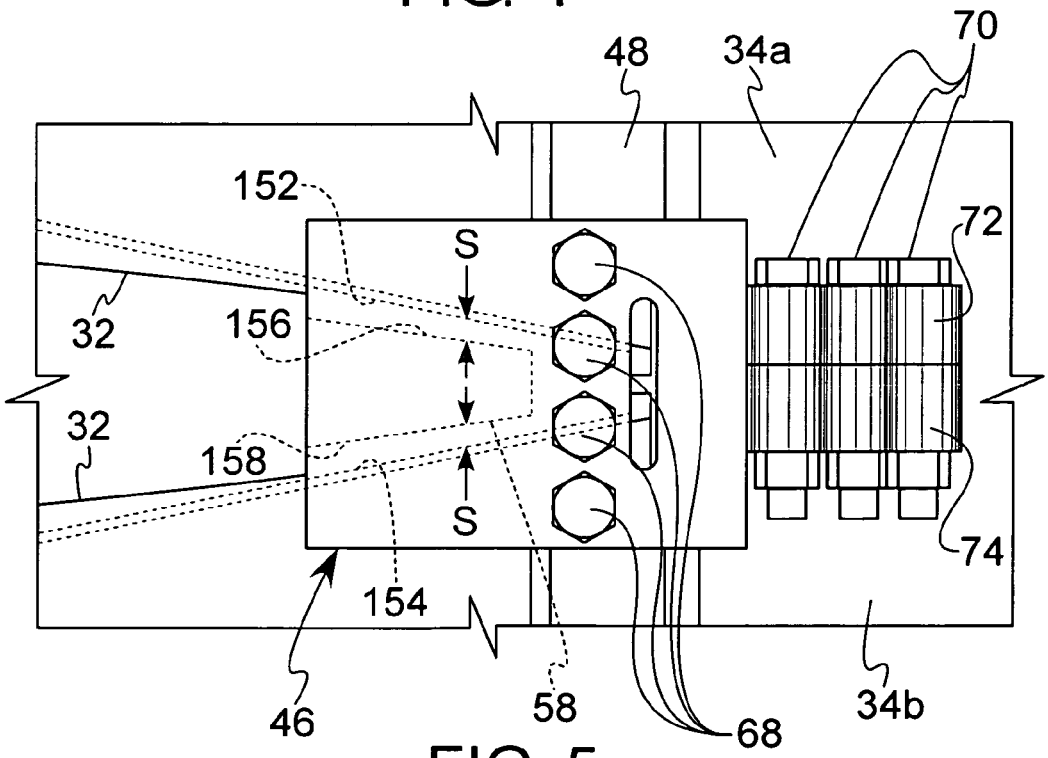
FIG. 5 is an enlarged top plan view of a portion of the entrance to the turbine assembly showing a joint between adjacent outer diameter sections of the framework.

Each of the OD and ID rings 34, 36 may be formed as a split ring, where each ring comprises a plurality of sectors joined together. In particular, the OD ring 34 may be formed of four sectors 34*a*, 34*b*, 34*c*, 34*d* (FIG. 3) joined together at circumferentially spaced bolted joints. For example, as seen in FIG. 5, showing the sectors 34*a*, 34*b*, the sectors 34*a*, 34*b* may be held together by three bolts 70 passing through flanges 72, 74 extending from the respective sectors 34*a*, 34*b* and located in abutting relation to each other. Each of the other adjacent pairs of sectors 34*b*, 34*c*; 34*c*, 34*d*; and 34*d*, 34*a* may be joined together in a similar manner.

Figure 4:
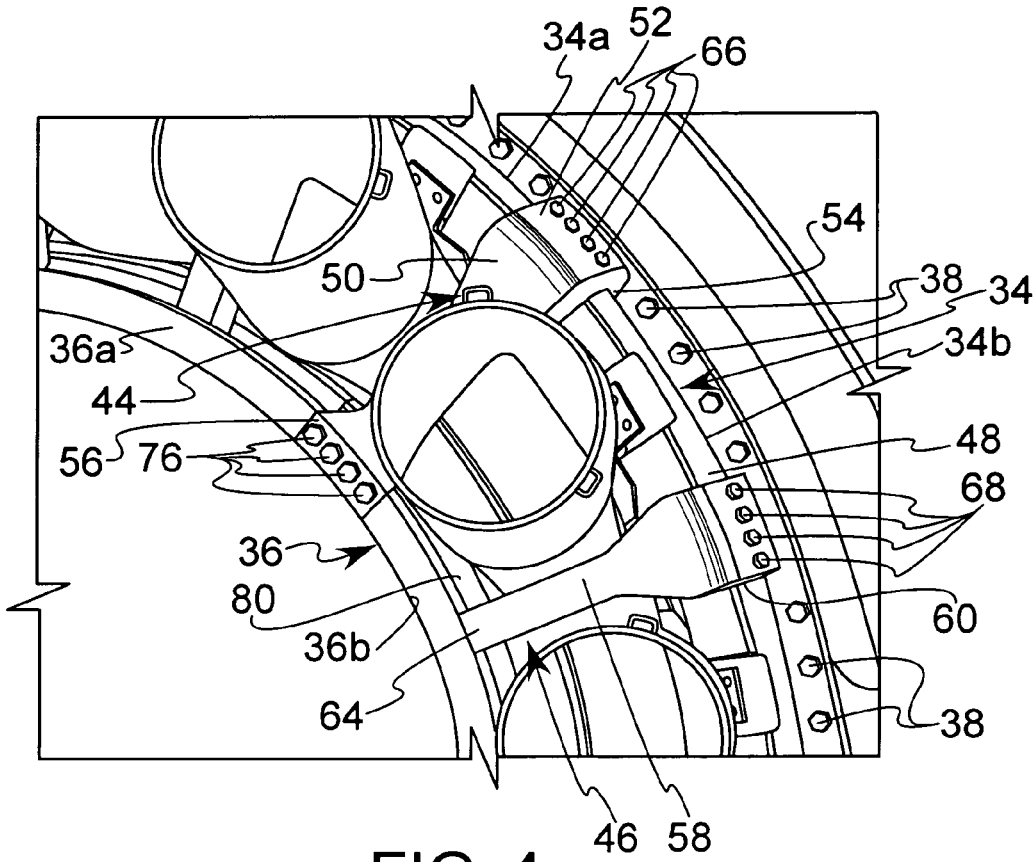
FIG. 4 is an enlarged perspective view of a portion of the entrance to the turbine assembly.

Referring to FIG. 3, the ID ring 36 may also be formed of four inner ring sectors 36*a*, 36*b*, 36*c*, 36*d*, where adjacent inner ring sectors 36*a*, 36*b*, 36*c*, 36*d* are joined together by the main struts 44. As seen in FIG. 4, illustrating a joint between inner ring sectors 36*a* and 36*b*, four bolts 76 may be provided to extend through the main strut 44 and fasten within corresponding holes in the adjacent inner ring sectors 36*a* and 36*b*, i.e., two bolts 76 in each of the sectors 36*a*, 36*b*, such that the inner end 56 of the main strut 44 bridges and connects the adjacent sectors 36*a*, 36*b*. The engagement of an inner end 56 of a main strut 44 with the ID ring 36 may be further seen in FIG. 1 in which an inner end 56 of a main strut 44 is illustrated in phantom and receives the bolt 76, also shown in phantom, engaged in the ID ring 36. The main struts 44 substantially rigidly support the ID ring 36 in cantilevered relation to the OD ring 34 to locate the ID ring 36 and to carry loads on the ID ring 36 in the radial and axial directions.

It should be noted that, within the scope of the present invention, the OD and ID rings 34, 36 may be formed with fewer or more sectors than described herein. Alternatively, some or all of the struts 44, 46 may be formed integrally with one or both of the OD and ID rings 34, 36.

As seen in FIG. 1, the inner ends 64 of the intermediate struts 46 are engaged within an annular slot 80, formed in an inner surface 82 of the ID ring 36. Front and rear faces 84, 86 of the intermediate struts 46 are positioned in close facing engagement with adjacent surfaces 88, 90 of the slot 80. The intermediate struts 46 operate with the main struts 44 to share axial loads applied to the ID ring 36 and thus maintain the position of the ID ring 36 relative to the OD ring 34. The inner ends 64 of the intermediate struts 46 are preferably spaced from the bottom 92 of the slot 80 in the ID ring 36 to permit radial movement of the inner ends 64 relative to the ID ring 36. The OD and ID rings 34, 36 with the struts 34, 36 form a rigid structure that provides a support for positioning the vanes 12 within the inner casing 16 where relative axial movement between the inner and outer portions of the framework structure 18 is substantially prevented. The non-bolted inner ends 64 of the intermediate struts 46 permit the intermediate struts 46 to be readily removed with removal of the bolts 68 at the OD ring 34, and thus facilitate maintenance operations requiring access through the area of the struts 44, 46.

Referring to FIG. 1, the vane 12 comprises an aft outer mounting element, shown as an aft outer flange 94, extending radially outwardly from an aft end of the outer shroud segment 26. A vane support 96 includes an outer end 98 engaged with an inner surface of the OD ring 34, and an inner end 100 defining a channel for engaging and supporting a track end of the aft outer flange 94. A clamp element 102 is bolted to the vane support 96 and fixes the track end of the aft outer flange 94 at a predetermined axial and radial location relative to the OD ring 34 to provide an outer reference mount 103 for the vane 12.

A U-shaped flexible seal 104 is provided extending between the transition duct 32 and a forward outer lip 106 of the outer shroud segment 26. The flexible seal 104 includes a connecting portion 108 that is fastened to a seal link 110 attached to the inner surface of the OD ring 34 to maintain the radial position of the flexible seal 104 relative to the OD ring 36. The flexible seal 104 provides a sealing connection between the aft edge 112 of the transition duct 32 and the forward outer lip 106 while permitting relative axial movement between the transition duct 32 and the forward outer lip 106. That is, axial movement of the forward outer lip 106 and/or the transition duct 32, such as may occur as a result of thermally induced expansion or contraction of the outer shroud segment 26 and/or the transition duct 32, will be accommodated by the flexible seal 104 to avoid thermally induced axial stresses in the vane 12.

A forward inner mounting element of the vane 12 is shown as a forward inner flange 114 extending radially inwardly from the forward end of the inner shroud segment 24. The inner surface 82 of the ID ring 36 is formed with an inner support member 115 comprising a vane locating channel 116 defined by opposing surfaces 118, 120. The forward inner flange 114 is positioned within the vane locating channel 116, such that forward and rearward faces 122, 124 of the forward inner flange 114 are located adjacent the respective opposing groove surfaces 118, 120. The opposing surfaces 118, 120 act as reaction surfaces for engaging the forward inner flange 114, defining an inner reference mount 126 for the vane 12, to maintain the forward inner flange 114 at a predetermined axial location and prevent pivoting movement of the vane 12 about the outer reference mount 103 defined at the aft outer flange 94. Further, an inner end of the forward inner flange 114 is radially spaced from a bottom surface of the vane locating channel 116 to permit radial movement of the forward inner flange 114 relative to the channel 116 to accommodate thermal movement, i.e., expansion or contraction, of the vane 12 in the radial direction.

A U-shaped flexible seal 128 is provided extending between the transition duct 32 and a forward inner lip 130 of the inner shroud segment 24. The flexible seal 128 includes a connecting portion 132 that is attached to the inner surface 82 of the ID ring 36 to maintain the radial position of the flexible seal 128 relative to the ID ring 36. The flexible seal 128 provides a sealing connection between the aft edge 112 of the transition duct 32 and the forward inner lip 130 while permitting relative axial movement between the transition duct 32 and the forward inner lip 130, such as may occur as a result of thermally induced expansion or contraction of the transition duct 32 and/or the inner shroud segment 24.

An aft inner sealing structure 134 of the vane 12 is shown as an aft inner flange 136 that extends radially inwardly from the inner shroud segment 24 to engage in a groove 138 formed in a seal segment 140. A support segment 142 extending from the compressor exit structure 144 supports the seal segment 140. The seal segment 140 is maintained in position on the support segment 142 by a fastener 146 extending through a slot 148 in the seal segment 140. The slot 148 in the seal segment 140 permits the seal segment 140 to move in an axial direction relative to the support segment 142 to accommodate movement of the aft end of the inner shroud segment 24 relative to the forward end thereof. In addition, an inner end of the aft inner flange 136 is radially spaced from a bottom surface of the groove 138 in the seal segment 140 to permit radial movement of the aft inner flange 136 relative to the groove 138 in order to accommodate thermal movement, i.e., expansion or contraction, of the vane 12 in the radial direction. The present invention is not limited to the particular aft inner sealing structure 134 disclosed herein, and it should be understood that alternative sealing structures may be incorporated in combination with the disclosed framework structure 18 to the extent that the sealing structures permit the described axial and radial movement of the shroud segments 24, 26 in response to thermal expansion and contraction of the vane 12.

The transition duct 32 extends into the framework structure 18, passing between adjacent struts 44, 46 to locate the aft end 112 closely adjacent to and spaced from the forward edges 149, 151 of the outer and inner shroud segments 24, 26 of the vane 12. The transition duct 32 may be provided with positioning structure, such as a radially extending flange 150, engaging the OD ring 34 to maintain the aft end 112 in a predetermined location relative to the framework structure 18 and thus maintain the aft end 112 in spaced relation to the vane 12. Referring to FIG. 5, it can be seen that sides 152, 154 of the transition ducts 32 are also located in spaced relation to the sides 156, 158 of the struts, as depicted by spacing S relative to intermediate strut 46, such that the transition ducts 32 are substantially maintained out of contact with the cantilevered components of the framework structure 18.

From the above description, it may be seen that the framework structure 18 comprises a cantilevered structure for supporting both the inner and outer ends of a vane 12. The cantilevered structure preferably provides a single outer reference mount for the vane 12 and a single inner reference mount for the vane 12 for accurately locating the vane 12 within the framework structure 18. The cantilevered struts 44, 46 supporting the ID ring 36 comprise a structure that maintains a substantially constant relative axial position between the outer and inner reference mounts 103, 126, which is substantially unaffected by variations in temperature in the area of the first row vanes 12 of the turbine 10.

Accordingly, the framework structure 18 described herein operates to minimize ID-to-OD rocking of the vanes 12 to reduce thermal stresses in the vanes 12 and improve sealing between the vanes 12 and the transition ducts 32. Further, the disclosed framework structure 18 is uniquely suited to providing support for non-metallic vanes, such as vanes formed of composite matrix ceramic (CMC) materials, and provides a support capable of accommodating thermal expansion mismatch between CMC and metal components.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A support for supporting vanes radially within an inner casing in a turbine engine, the vanes located in a hot gas flow from a combustor, on an upstream side, to a turbine section, on a downstream side, the support comprising:

a framework including an outer vane carrier rigidly supported to an upstream end of the inner casing of the turbine engine, and an inner vane carrier located radially inwardly from the outer vane carrier;

a strut structure comprising a plurality of circumferentially spaced struts rigidly attached to said outer vane carrier and extending radially inwardly from said outer vane carrier and rigidly connected to and supporting said inner vane carrier;

said outer vane carrier including an outer support member for engaging and supporting a radially outer flange of one or more of said vanes at a downstream location from said strut structure;

said inner vane carrier including an inner support member for engaging and supporting a radially inner flange of said one or more vanes; and wherein said inner vane carrier is supported in cantilevered relation to said outer vane carrier by said plurality of struts.

2. The support of claim 1, wherein said inner support member locates the position of said inner flange of said one or more vanes in an axial direction.

3. The support of claim 2, wherein said inner support member comprises a channel for receiving said inner flange of said one or more vanes.

4. The support of claim 3, wherein said inner flange is radially movable relative to said inner support member.

5. The support of claim 2, wherein said inner flange comprises a forward radially inner flange at an upstream location on said one or more vanes, and said one or more vanes further include an aft radially inner flange at a downstream location on said one or more vanes, and said inner support member engages said forward inner flange.

6. The support of claim 5, wherein said aft inner flange is engaged with an aft inner seal permitting radial and axial movement of said aft inner flange relative to said framework.

7. The support of claim 5, wherein said radially outer flange of said one or more vanes comprises an aft radially outer flange at a downstream location on said one or more vanes, and said outer support member engages said aft outer flange to locate said aft outer flange in a predetermined radial and axial location relative to said outer vane carrier.

8. The support of claim 1, wherein said outer vane carrier is mounted to a front face on an upstream side of the inner casing.

9. A support for supporting a vane radially within an inner casing in a turbine engine, the vane located in a hot gas flow from a combustor, on an upstream side, to a turbine section, on a downstream side, the support comprising:

a framework mounted to the inner casing and including an annular outer vane carrier located radially outwardly adjacent to an upstream end of the inner casing, and an annular inner vane carrier located radially inwardly from the outer vane carrier;

a strut structure comprising a plurality of circumferentially spaced struts rigidly attached to said outer vane carrier and extending radially inwardly from said outer vane carrier and said strut structure rigidly connected to said inner vane carrier;

said outer vane carrier including an outer support member for engaging and supporting a radially outer flange of said vane at a downstream location from said strut structure;

said inner vane carrier including an inner support member for engaging and supporting a radially inner flange of said vane to axially locate said inner flange; and wherein said inner vane carrier is supported in cantilevered relation to said outer vane carrier by said plurality of struts.

10. The support of claim 9, wherein said vane includes a forward radially inner edge at an upstream location and an aft radially inner edge at a downstream location, and said inner flange of said vane is located adjacent said forward inner edge.

11. The support of claim 10, wherein said inner support member comprises a channel for receiving said inner flange of said vane.

12. The support of claim 10, wherein said vane includes a forward radially outer edge at an upstream location and an aft radially outer edge at a downstream location, and said outer flange is located adjacent said aft outer edge to locate said outer flange in a predetermined radial and axial location relative to said outer vane carrier.

13. The support of claim 12, wherein said vane includes an aft inner flange engaged with an aft inner seal permitting radial and axial movement of said aft inner flange relative to said framework.

14. The support of claim 13, including axially flexible seals connecting said forward outer and inner edges of said vane to a transition member of said turbine engine.

15. The support of claim 9, wherein said plurality of struts are removable from said framework.

16. The support of claim 15, wherein said struts comprise a plurality of main struts, said inner vane carrier comprises a ring formed of a plurality of adjacent ring sectors and adjacent ring sectors are joined together by one of said main struts attached to and bridging between the adjacent ring sectors.

17. The support of claim 16, wherein said inner vane carrier comprises an annular slot and said struts further comprise a plurality of intermediate struts located between said main struts, said intermediate struts having a radially outer end rigidly attached to said outer vane carrier and a radially inner end positioned in said annular slot.

18. A vane assembly in a turbine engine comprising an inner casing, the vane assembly located within a hot gas flow passing within the inner casing from a combustor, on an upstream side, to a turbine section, on a downstream side, the assembly comprising:

a framework mounted to and extending radially inwardly from an upstream face of the inner casing and including an annular outer vane carrier located radially outwardly adjacent to the inner casing and an annular inner vane carrier located radially inwardly from said outer vane carrier;

a strut structure comprising a plurality of circumferentially spaced struts rigidly attached to said outer vane carrier, and said strut structure rigidly connected to said inner vane carrier to support said inner vane carrier in cantilevered relation radially inwardly from said outer vane carrier;

a plurality of first row turbine vanes supported from said outer vane carrier at a downstream location from said strut structure; and said inner vane carrier including an inner support member for engaging and supporting said turbine vanes from said inner vane carrier for locating said turbine vanes in an axial direction relative to said inner vane carrier.

19. The assembly of claim 18, wherein said turbine vanes comprise a forward radially inner edge at an upstream location and an aft radially inner edge at a downstream location, and each said turbine vane includes a radially inner flange located adjacent said forward inner edge engaged with a channel in said inner support member.

20. The assembly of claim 18, including a plurality of transition ducts located to direct hot gases from a location upstream of said support structure to said vanes, each transition duct comprising sidewalls extending between and in spaced relation to adjacent pairs of said struts.

* * * * *